US005240672A

United States Patent [19]

Yang

[11] Patent Number: 5,240,672

[45] Date of Patent: Aug. 31, 1993

[54] METHOD FOR MAKING GRADED COMPOSITE BODIES PRODUCED THEREBY

[75] Inventor: Chwen-Chih Yang, Newark, Del.

[73] Assignee: Lanxide Technology Company, LP, Newark, Del.

[21] Appl. No.: 692,748

[22] Filed: Apr. 29, 1991

[51] Int. Cl.[5] ..... B22F 1/00; C22C 1/02

[52] U.S. Cl. ..... 419/47; 419/10

[58] Field of Search ..... 428/546, 547, 549, 550, 428/551, 552, 553, 554, 555, 556, 557, 610; 164/91; 419/10, 47

[56] References Cited

U.S. PATENT DOCUMENTS

| | | | |
|---|---|---|---|
| 3,367,398 | 2/1968 | Riley et al. | 164/97 |
| 3,836,341 | 9/1974 | Saltzman et al. | 29/191.6 |
| 4,089,466 | 5/1978 | Lomax et al. | 220/454 |
| 4,100,664 | 7/1978 | Straesser | 29/156.6 |
| 4,107,392 | 8/1978 | Aoki et al. | 428/547 |
| 4,357,394 | 11/1982 | Khandros | 428/595 |
| 4,399,198 | 8/1983 | Lomax et al. | 428/595 |
| 4,828,008 | 5/1989 | White et al. | 164/66.1 |
| 4,851,190 | 7/1989 | Bowen et al. | 419/66 |
| 4,935,055 | 6/1990 | Aghajanian et al. | 164/66.1 |
| 4,995,444 | 2/1991 | Jolly et al. | 164/97 |
| 5,000,247 | 3/1991 | Burke | 164/97 |
| 5,020,584 | 6/1991 | Aghajanian et al. | 164/97 |
| 5,023,145 | 6/1991 | Lomax et al. | 428/614 |

FOREIGN PATENT DOCUMENTS 0368788 5/1990 European Pat. Off. .

OTHER PUBLICATIONS

"Formation of Solidification Microstructures in Cast Metal Matrix Paritcle Composites", P. K. Rohatgi, R. Asthana, and F. Yarandi. "Solidification of Metal Matrix Composites", ed. P. K. Rohatgi (Warrendale, PA: TMS, 1990), pp. 51-75.

"Cast Aluminum-Matrix Composites for Automotive Applications"-Pradeep Rohatgi, Apr. 1991, Journal of Metals, pp. 10-15.

"Morphology and Wear of Single and Multicarbide Composite Alloy", Giri Rajendran and Greg Patzer, Tribology of Composite Materials, Proceedings of a Conference, Oak Ridge, Tenn., 1-3 May 1990, ASM International, Materials Park, Ohio, pp. 169-180.

*Primary Examiner*—Donald P. Walsh
*Assistant Examiner*—Daniel Jenkins
*Attorney, Agent, or Firm*—Mark G. Mortenson; Stanislav Antolin; Kevin J. Boland

[57] ABSTRACT

The present invention relates to the formation of bodies having graded properties. Particularly, the invention provides a method for forming a metal matrix composite body having graded properties. The graded properties are achieved by, for example, locating differing amounts of filler material in different portions of a formed body and/or locating different compositions of filler material in different portions of a formed body and/or locating different sizes of filler materials in different portions of a formed body. In addition, the invention provides for the formation of macrocomposite bodies wherein, for example, an excess of matrix metal can be integrally bonded or attached to a graded metal matrix composite portion of a macrocomposite body.

24 Claims, 5 Drawing Sheets

METHOD FOR MAKING GRADED COMPOSITE BODIES PRODUCED THEREBY

FIELD OF THE INVENTION

The present invention relates to the formation of bodies having graded properties. Particularly, the invention provides a method for forming a metal matrix composite body having graded properties. The graded properties are achieved by, for example, locating differing amounts of filler material in different portions of a formed body and/or locating different compositions of filler material in different portions of a formed body and/or locating different sizes of filler materials in different portions of a formed body. In addition, the invention provides for the formation of macrocomposite bodies wherein, for example, an excess of matrix metal can be integrally bonded or attached to a graded metal matrix composite portion of a macrocomposite body.

BACKGROUND OF THE INVENTION

Numerous attempts have been made in the art to form metal matrix composite bodies by varying techniques. Techniques such as injection of molten metal into reinforcing materials to form composites as well as the mixing or pouring of other materials into molten metals are well known.

The interest in composite products comprising a metal matrix and a strengthening or reinforcing phase such as ceramic particulates, whiskers, fibers or the like, has arisen because metal matrix composites show great promise for a variety of applications in that they combine some of the stiffness and wear resistance of the reinforcing phase with the ductility and toughness of the metal matrix. Generally, a metal matrix composite will show an improvement in such properties as strength, stiffness, contact wear resistance, and elevated temperature strength retention relative to the matrix metal in monolithic form, but the degree to which any given property may be improved depends largely on the specific constituents, their volume or weight fraction, and how they are processed in forming the composite. In some instances, the composite also may be lighter in weight than the matrix metal per se. Aluminum matrix composites reinforced with ceramics such as silicon carbide in particulate, platelet, or whisker form, for example, are of interest because of their higher stiffness, wear resistance and high temperature strength relative to aluminum.

Various metallurgical processes have been described in the art for the fabrication of aluminum matrix composites, including methods based on powder metallurgy techniques and liquid-metal infiltration techniques which make use of pressure casting, vacuum casting, stirring, and wetting agents. With powder metallurgy techniques, the metal in the form of a powder and the reinforcing material in the form of a powder, whiskers, chopped fibers, etc., are admixed and then either cold-pressed and sintered, or hot-pressed. The maximum ceramic volume fraction in silicon carbide reinforced aluminum matrix composites produced by this method has been reported to be about 25 volume percent in the case of whiskers, and about 40 volume percent in the case of particulates.

The production of metal matrix composites by powder metallurgy techniques utilizing conventional processes imposes certain limitations with respect to the characteristics of the products attainable. The volume fraction of the ceramic phase in the composite is limited typically, in the case of particulates, to about 40 percent. Also, the pressing operation poses a limit on the practical size attainable. Only relatively simple product shapes are possible without subsequent processing (e.g., forming or machining) or without resorting to complex presses. Also, nonuniform shrinkage during sintering can occur, as well as nonuniformity of microstructure due to segregation in the compacts and grain growth.

U.S. Pat. No. 3,970,136, granted Jul. 20, 1976, to J. C. Cannell et al., describes a process for forming a metal matrix composite incorporating a fibrous reinforcement, e.g. silicon carbide or alumina whiskers, having a predetermined pattern of fiber orientation. The composite is made by placing parallel mats or felts of coplanar fibers in a mold with a reservoir of molten matrix metal, e.g., aluminum, between at least some of the mats, and applying pressure to force molten metal to penetrate the mats and surround the oriented fibers. Molten metal may be poured onto the stack of mats while being forced under pressure to flow between the mats. Loadings of up to about 50% by volume of reinforcing fibers in the composite have been reported.

The above-described infiltration process, in view of its dependence on outside pressure to force the molten matrix metal through the stack of fibrous mats, is subject to the vagaries of pressure-induced flow processes, i.e., possible non-uniformity of matrix formation, porosity, etc. Non-uniformity of properties is possible even though molten metal may be introduced at a multiplicity of sites within the fibrous array. Consequently, complicated mat/reservoir arrays and flow pathways need to be provided to achieve adequate and uniform penetration of the stack of fiber mats. Also, the aforesaid pressure-infiltration method allows for only a relatively low reinforcement to matrix volume fraction to be achieved because of the difficulty inherent in infiltrating a large mat volume. Still further, molds are required to contain the molten metal under pressure, which adds to the expense of the process. Finally, the aforesaid process, limited to infiltrating aligned particles or fibers, is not directed to formation of aluminum metal matrix composites reinforced with materials in the form of randomly oriented particles, whiskers or fibers.

In the fabrication of aluminum matrix-alumina filled composites, aluminum does not readily wet alumina, thereby making it difficult to form a coherent product. Various solutions to this problem have been suggested. One such approach is to coat the alumina with a metal (e.g., nickel or tungsten), which is the hot-pressed along with the aluminum. In another technique, the aluminum is alloyed with lithium, and the alumina may be coated with silica. However, these composites exhibit variations in properties, or the coatings can degrade the filler, or the matrix contains lithium which can affect the matrix properties.

U.S. Pat. No. 4,232,091 to R. W. Grimshaw et al., overcomes certain difficulties in the art which are encountered in the production of aluminum matrix-alumina composites. This patent describes applying pressures of 75–375 kg/cm$^2$ to force molten aluminum (or molten aluminum alloy) into a fibrous or whisker mat of alumina which has been preheated to 700° to 1050° C. The maximum volume ratio of alumina to metal in the resulting solid casting was 0.25/1. Because of its dependency on outside force to accomplish infiltration, this process is subject to many of the same deficiencies as that of Cannell et al.

European Patent Application Publication No. 115,742 describes making aluminum-alumina composites, especially useful as electrolytic cell components, by filling the voids of a preformed alumina matrix with molten aluminum. The application emphasizes the nonwettability of alumina by aluminum, and therefore various techniques are employed to wet the alumina throughout the preform. For example, the alumina is coated with a wetting agent of a diboride of titanium, zirconium, hafnium, or niobium, or with a metal, i.e., lithium, magnesium, calcium, titanium, chromium, iron, cobalt, nickel, zirconium, or hafnium. Inert atmospheres, such as argon, are employed to facilitate wetting. This reference also shows applying pressure to cause molten aluminum to penetrate an uncoated matrix. In this aspect, infiltration is accomplished by evacuating the pores and then applying pressure to the molten aluminum in an inert atmosphere, e.g., argon. Alternatively, the preform can be infiltrated by vapor-phase aluminum deposition to wet the surface prior to filling the voids by infiltration with molten aluminum. To assure retention of the aluminum in the pores of the preform, heat treatment, e.g., at 1400° to 1800° C., in either a vacuum or in argon is required. Otherwise, either exposure of the pressure infiltrated material to gas or removal of the infiltration pressure will cause loss of aluminum from the body.

The use of wetting agents to effect infiltration of an alumina component in an electrolytic cell with molten metal is also shown in European Patent Application Publication No. 94353. This publication describes production of aluminum by electrowinning with a cell having a cathodic current feeder as a cell liner or substrate. In order to protect this substrate from molten cryolite, a thin coating of a mixture of a wetting agent and solubility suppressor is applied to the alumina substrate prior to start-up of the cell or while immersed in the molten aluminum produced by the electrolytic process. Wetting agents disclosed are titanium, zirconium, hafnium, silicon, magnesium, vanadium, chromium, niobium, or calcium, and titanium is stated as the preferred agent. Compounds of boron, carbon and nitrogen are described as being useful in suppressing the solubility of the wetting agents in molten aluminum. The reference, however, does not suggest the production of metal matrix composites, nor does it suggest the formation of such a composite in, for example, a nitrogen atmosphere.

In addition to application of pressure and wetting agents, it has been disclosed that an applied vacuum will aid the penetration of molten aluminum into a porous ceramic compact. For example, U.S. Pat. No. 3,718,441, granted Feb. 27, 1973, to R. L. Landingham, reports infiltration of a ceramic compact (e.g., boron carbide, alumina and beryllia) with either molten aluminum, beryllium, magnesium, titanium, vanadium, nickel or chromium under a vacuum of less than $10^{-6}$ torr. A vacuum of $10^{-2}$ to $10^{-6}$ torr resulted in poor wetting of the ceramic by the molten metal to the extent that the metal did not flow freely into the ceramic void spaces. However, wetting was said to have improved when the vacuum was reduced to less than $10^{-6}$ torr.

U.S. Pat. No. 3,864,154, granted Feb. 4, 1975, to G. E. Gazza et al., also shows the use of vacuum to achieve infiltration. This patent describes loading a cold-pressed compact of $AlB_{12}$ powder onto a bed of cold-pressed aluminum powder. Additional aluminum was then positioned on top of the $AlB_{12}$ powder compact. The crucible, loaded with the $AlB_{12}$ compact "sandwiched" between the layers of aluminum powder, was placed in a vacuum furnace. The furnace was evacuated to approximately $10^{-5}$ torr to permit outgassing. The temperature was subsequently raised to 1100° C. and maintained for a period of 3 hours. At these conditions, the molten aluminum penetrated the porous $AlB_{12}$ compact.

U.S. Pat. No. 3,364,976, granted Jan. 23, 1968, to John N. Reding et al., discloses the concept of creating a self-generated vacuum in a body to enhance penetration of a molten metal into the body. Specifically, it is disclosed that a body, e.g., a graphite mold, a steel mold, or a porous refractory material, is entirely submerged in a molten metal. In the case of a mold, the mold cavity, which is filled with a gas reactive with the metal, communicates with the externally located molten metal through at least one orifice in the mold. When the mold is immersed into the melt, filling of the cavity occurs as the self-generated vacuum is produced from the reaction between the gas in the cavity and the molten metal. Particularly, the vacuum is a result of the formation of a solid oxidized form of metal. Thus, Reding et al. disclose that it is essential to induce a reaction between gas in the cavity and the molten metal. However, utilizing a mold to create a vacuum may be undesirable because of the inherent limitations associated with use of a mold. Molds must first be machined into a particular shape; then finished, machined to produce an acceptable casting surface on the mold; then assembled prior to their use; then disassembled after their use to remove the cast piece therefrom; and thereafter reclaim the mold, which most likely would include refinishing surfaces of the mold or discarding the mold if it is no longer acceptable for use. Machining of a mold into a complex shape can be very costly and time-consuming. Moreover, removal of a formed piece from a complex-shaped mold can also be difficult (i.e., cast pieces having a complex shape could be broken when removed from the mold). Still further, while there is a suggestion that a porous refractory material can be immersed directly in a molten metal without the need for a mold, the refractory material would have to be an integral piece because there is no provision for infiltration a loose or separated porous material absent the use of a container mold (i.e., it is generally believed that the particulate material would typically disassociate or float apart when placed in a molten metal). Still further, if it was desired to infiltrate a particulate material or loosely formed preform, precautions should be taken so that the infiltrating metal does not displace at least portions of the particulate or preform resulting in a non-homogeneous microstructure.

Moreover, infiltration techniques which have come to be known as "spontaneous infiltration" or "pressureless infiltration" (and discussed in the section herein entitled "Description of Commonly Owned U.S. Patents and Patent Applications") also provide methods for forming both metal matrix composite bodies and macrocomposite bodies, at least a portion of which comprises a metal matrix composite body.

However, there still exists a long felt need for a simple and reliable process to manufacture shaped and graded metal matrix composite bodies and shaped macrocomposite bodies, at least a portion of which comprises a graded metal matrix composite body. The ability to manufacture or tailor a composite body so as to control properties as a function of position within the composite body greatly expands the utility of the body and fills a technical need that has existed for many years. Specifically, the present invention satisfies this need by providing a simple, reliable, safe and cost effective technique for forming graded metal matrix composite bodies and macrocomposite bodies, wherein at least a portion of the macrocomposite comprises a graded metal matrix composite body.

DESCRIPTION OF COMMONLY OWNED U.S. PATENTS AND PATENT APPLICATIONS

The subject matter of this application is related to that of several other copending and co-owned patent applications and co-owned patents. Particularly, these other copending patent applications and co-owned patents describe novel methods for making metal matrix composite materials (hereinafter sometimes referred to as "Commonly Owned Metal Matrix Patents and Patent Applications").

A novel method of making a metal matrix composite material is disclosed in commonly owned U.S. Pat. No. 4,828,008, which issued on May 9, 1989, from U.S. patent application Ser. No. 07/049,171, filed May 13, 1987, in the names of White et al., and entitled "Metal Matrix Composites". According to the method of the White et al. invention, a metal matrix composite is produced by infiltrating a permeable mass of filler material (e.g., a ceramic or a ceramic-coated material) with molten aluminum containing at least about 1 percent by weight magnesium, and preferably at least about 3 percent by weight magnesium. Infiltration occurs spontaneously without the application of external pressure or vacuum. A supply of the molten metal alloy is contacted with the mass of filler material at a temperature of at least about 675° C. in the presence of a gas comprising from about 10 to 100 percent, and preferably at least about 50 percent, nitrogen by volume, and a remainder of the gas, if any, being a nonoxidizing gas, e.g., argon. Under these conditions, the molten aluminum alloy infiltrates the ceramic mass under normal atmospheric pressures to form an aluminum (or aluminum alloy) matrix composite. When the desired amount of filler material has been infiltrated with the molten aluminum alloy, the temperature is lowered to solidify the alloy, thereby forming a solid metal matrix structure that embeds the reinforcing filler material. Usually, and preferably, the supply of molten alloy delivered will be sufficient to permit the infiltration to proceed essentially to the boundaries of the mass of filler material. The amount of filler material in the aluminum matrix composites produced according to the White et al. invention may be exceedingly high. In this respect, filler to alloy volumetric ratios of greater than 1:1 may be achieved.

Under the process conditions in the aforesaid White et al. invention, aluminum nitride can form as a discontinuous phase dispersed throughout the aluminum matrix. The amount of nitride in the aluminum matrix may vary depending on such factors as temperature, alloy composition, gas composition and filler material. Thus, by controlling one or more such factors in the system, it is possible to tailor certain properties of the composite. For some end use applications, however, it may be desirable that the composite contain little or substantially no aluminum nitride.

It has been observed that higher temperatures favor infiltration but render the process more conducive to nitride formation. The White et al. invention allows the choice of a balance between infiltration kinetics and nitride formation.

An example of suitable barrier means for use with metal matrix composite formation is described in commonly owned U.S. Pat. No. 4,935,055, which issued on Jun. 19, 1990, from U.S. patent application Ser. No. 07/141,642, filed Jan. 7, 1988, in the names of Michael K. Aghajanian et al., and entitled "Method of Making Metal Matrix Composite with the Use of a Barrier" (a European counterpart to which was published in the EPO on Jul. 12, 1989, as Publication No. 0 323 945). According to the method of this Aghajanian et al. invention, a barrier means (e.g., particulate titanium diboride or a graphite material such as a flexible graphite tape product sold by Union Carbide under the trade name Grafoil®) is disposed on a defined surface boundary of a filler material and matrix alloy infiltrates up to the boundary defined by the barrier means. The barrier means is used to inhibit, prevent, or terminate infiltration of the molten alloy, thereby providing net, or near net, shapes in the resultant metal matrix composite. Accordingly, the formed metal matrix composite bodies have an outer shape which substantially corresponds to the inner shape of the barrier means.

The method of U.S. Pat. No. 4,828,008 was improved upon by commonly owned and copending U.S. patent application Ser. No. 07/517,541, filed Apr. 24, 1990 (and now abandoned) which is a continuation application of U.S. patent application Ser. No. 07/168,284, filed Mar. 15, 1988 (and now abandoned) in the names of Michael K. Aghajanian and Marc S. Newkirk and entitled "Metal Matrix Composites and Techniques for Making the Same" (a European counterpart to which was published in the EPO on Sep. 20, 1989, as Publication No. 0 333 629). In accordance with the methods disclosed in this patent application, a matrix metal alloy is present as a first source of metal and as a reservoir of matrix metal alloy which communicates with the first source of molten metal due to, for example, gravity flow. Particularly, under the conditions described in this patent application, the first source of molten matrix alloy begins to infiltrate the mass of filler material under normal atmospheric pressures and thus begins the formation of a metal matrix composite. The first source of molten matrix metal alloy is consumed during its infiltration into the mass of filler material and, if desired, can be replenished, preferably by a continuous means, from the reservoir of molten matrix metal as the spontaneous infiltration continues. When a desired amount of permeable filler has been spontaneously infiltrated by the molten matrix alloy, the temperature is lowered to solidify the alloy, thereby forming a solid metal matrix structure that embeds the reinforcing filler material. It should be understood that the use of a reservoir of metal is simply one embodiment of the invention described in this patent application and it is not necessary to combine the reservoir embodiment with each of the alternate embodiments of the invention disclosed therein, some of which could also be beneficial to use in combination with the present invention.

The reservoir of metal can be present in an amount such that it provides for a sufficient amount of metal to infiltrate the permeable mass of filler material to a predetermined extent. Alternatively, an optional barrier means can contact the permeable mass of filler on at least one side thereof to define a surface boundary.

Moreover, while the supply of molten matrix alloy delivered should be at least sufficient to permit spontaneous infiltration to proceed essentially to the boundaries (e.g., barriers) of the permeable mass of filler material, the amount of alloy present in the reservoir could exceed such sufficient amount so that not only will there be a sufficient amount of alloy for complete infiltration, but excess molten metal alloy could remain and be attached to the metal matrix composite body. Thus, when excess molten alloy is present, the resulting body will be a complex composite body (e.g., a macrocomposite), wherein an infiltrated ceramic body having a metal matrix therein will be directly bonded to excess metal remaining in the reservoir.

In another patent application relating to macrocomposite bodies, namely, U.S. patent application Ser. No. 07/269,464, filed Nov. 10, 1988 (and now U.S. Pat. No. 5,040,588, issued Aug. 20, 1991), in the names of Newkirk et al., and entitled "Methods For Forming Macrocomposite Bodies and Macrocomposite Bodies Produced Thereby" (a European counterpart to which was published in the EPO on May 23, 1990, as Publication No. 0 369 931), there are disclosed further techniques for the formation of macrocomposite bodies and novel materials produced thereby. This application discloses that a permeable mass of filler or preform is placed adjacent to a second or additional body and molten matrix metal is caused to infiltrate the filler or preform up to the second or additional body, resulting in the metal matrix composite body being bonded to the second body. In addition, it is disclosed that excess or residual matrix metal may also be present and bonded to a formed metal matrix composite portion of the macrocomposite body.

Further related technology can be found in commonly owned U.S. Pat. No. 5,000,247, which issued on Mar. 19, 1991, in the name of John T. Burke, and entitled "Method For Forming Metal Matrix Composite Bodies With a Dispersion Casting Technique and Products Produced Thereby" (a European counterpart to which was published in the EPO on May 16, 1990, as Publication No. 0 368 788). In this patent, there is disclosed the formation of a spontaneously infiltrated filler and the mixing of additional matrix metal into said spontaneously infiltrated filler. One concept disclosed in this patent is that a suspension of metal and spontaneously infiltrated filler can be formed, said suspension being capable of being poured into a mold which can correspond to the final shape of a desired metal matrix composite body to be formed. It is further disclosed that particle loadings of about 5–40 volume percent filler can be achieved in the formed metal matrix composite body. A continuation-in-part application relating to U.S. Pat. No. 5,000,247 was filed on Mar. 18, 1991, as U.S. Ser. No. 07/672,064 in the name of John T. Burke, and entitled "Method For Forming Metal Matrix Composite Bodies With a Dispersion Casting Technique and Products Produced Thereby." This application disclosed further examples for forming metal matrix composite bodies by a dispersion casting technique.

A method for making a metal matrix composite body having a variable and tailorable volume fraction is disclosed in copending and co-owned U.S. patent application Ser. No. 07/269,312, filed in the names of Michael K. Aghajanian et al. on Nov. 10, 1988 (and now U.S. Pat. No. 4,020,584, issued Jun. 4, 1991, and entitled "A Method For Forming Metal Matrix Composites Having Variable Filler Loadings and Products Produced Thereby" (a European counterpart to which was published in the EPO on May 23, 1990, as Publication No. 0 369 928). This application discloses that powdered metal, having a similar or a different composition from the matrix metal, can be added to a filler material or preform and functions as a spacer to reduce the volume percent of filler in the produced metal matrix composite body. It is further disclosed that different filler particle to powdered matrix metal loadings may be employed along different parts of a particular body, e.g., to optimize wear, corrosion or erosion resistance, at particularly vulnerable locations of the product and/or to otherwise alter the properties of the body at different locations to suit a particular application.

Each of the above-discussed Commonly Owned Metal Matrix Patents and Patent Applications describes methods for the production of metal matrix composite bodies and novel metal matrix composite bodies which are produced therefrom. The entire disclosures of all of the foregoing Commonly Owned Metal Matrix Patents and Patent Applications are expressly incorporated herein by reference.

SUMMARY OF THE INVENTION

A composite body having graded properties is produced by forming a molten suspension of filler and matrix metal and placing the molten suspension into the shaped cavity of a mold. The molten suspension is maintained in the mold at a sufficient temperature and for a sufficient amount of time to permit the filler in the molten suspension to at least partially settle within the mold. When the filler is carefully chosen (e.g., combinations of specific particle size distributions, and/or specific particle density distributions and/or specific particle chemical compositions, etc.), the filler can be controlled so that it desirably settles within a bottom portion of the mold, due to, for example gravitational forces. Such settling of filler from the molten suspension into the bottom portion of a mold can result in a desirable metal matrix composite body having graded properties and/or a desirable macrocomposite body, at least a portion of which comprises a graded metal matrix composite body.

Various teachings for forming a suspension comprising a filler in a matrix metal are applicable to the present invention. For example, powdered matrix metal and filler can be mixed and heated to form a suspension. Alternatively, a molten body of matrix metal can be provided into which a filler is poured and mixed by an appropriate agitation means. Still further, a filler can be infiltrated by any appropriate technique including pressure casing, spontaneous or pressureless infiltration, etc., to form a molten suspension. In all instances, once a molten suspension is formed, the suspension is caused to be located by pouring, casting, injecting, etc., said suspension into a cavity of a mold of a desirable size and shape. The amount of time that the suspension is housed or dwells within the mold and the temperature which the suspension experiences during such dwell time contributes to the type and/or amount of filler settling which occurs. Accordingly, it is the synergism between all ingredients in the molten suspension, as well as the temperature to which the molten suspension is subjected and the time which the molten suspension dwells within a mold (i.e., the amount of time prior to the matrix metal of the molten suspension hardening) which influence the properties of a formed graded composite body.

DEFINITIONS

"Aluminum", as used herein, means and includes essentially pure metal (e.g., a relatively pure, commercially available unalloyed aluminum) or other grades of metal and metal alloys such as the commercially available metals having impurities and/or alloying constituents such as iron, silicon, copper, magnesium, manganese, chromium, zinc, etc., therein. An aluminum alloy for purposes of this definition is an alloy or intermetallic compound in which aluminum is the major constituent.

"Balance Non-Oxidizing Gas", as used herein, means that any gas present in addition to the primary gas comprising the infiltrating atmosphere is either an inert gas or a reducing gas which is substantially non-reactive with the matrix metal under the process conditions. Any oxidizing gas which may be present as an impurity in the gas(es) used should be insufficient to oxidize the matrix metal to any substantial extent under the process conditions.

"Barrier" or "barrier means", as used herein, means any suitable means which interferes, inhibits, prevents or terminates the migration, movement, or the like, of molten matrix metal beyond a surface boundary of a permeable mass of filler material, where such surface boundary is defined by said barrier means. Suitable barrier means may be any such material, compound, element, composition, or the like, which, under the process conditions, maintains some integrity and is not substantially volatile (i.e., the barrier material does not volatilize to such an extent that it is rendered non-function as a barrier).

Further, suitable "barrier means" includes materials which are substantially non-wettable by the migrating molten matrix metal under the process conditions employed. A barrier of this type appears to exhibit substantially little or no affinity for the molten matrix metal, and movement beyond the defined surface boundary of the mass of filler material is prevented or inhibited by the barrier means. The barrier reduces any final machining or grinding that may be required and defines at least a portion of the surface of the resulting metal matrix composite product. The barrier may in certain cases be permeable or porous, or rendered permeable by, for example, drilling holes or puncturing the barrier, to permit gas to contact the molten matrix metal.

"Filler", as used herein, is intended to include either single constituents or mixtures of constituents which are substantially non-reactive with and/or of limited solubility in the matrix metal and may be single or multiphase. Fillers may be provided in a wide variety of forms, such as powders, flakes, platelets, microspheres, whiskers, bubbles, etc., and may be either dense or porous. "Filler" may also include ceramic fillers, such as alumina or silicon carbide as fibers, chopped fibers, particulates, whiskers, bubbles, spheres, fiber mats, or the like, and ceramic-coated fillers such as carbon fibers coated with alumina or silicon carbide to protect the carbon from attack, for example, by a molten aluminum matrix metal. Fillers may also include metals.

"Graded Metal Matrix Composite", as used herein, means that the formed metal matrix composite, whether formed alone or formed as part of a macrocomposite, exhibits at least one property which differs from one portion thereof to an opposite portion thereof. Typically, the property variation is observed in the settling direction (i.e., that direction in which the filler builds or stacks up) in the metal matrix composite body.

"Highly Loaded Metal Matrix Composite", as used herein, means a metal matrix composite material which has first been formed by any appropriate technique, including the spontaneous infiltration of a matrix metal into a filler material, and which filler material has not had any substantial amount of second or additional matrix metal added thereto to result in a reduced ratio of filler to matrix metal.

"Infiltrating Atmosphere", as used herein, means that atmosphere which is present which interacts with the matrix metal and/or preform (or filler material) and/or infiltration enhancer precursor and/or infiltration enhancer and permits or enhances spontaneous infiltration of the matrix metal to occur.

"Infiltration Enhancer", as used herein, means a material which promotes or assists in the spontaneous infiltration of a matrix metal into a filler material or preform. An infiltration enhancer may be formed from, for example, (1) a reaction of an infiltration enhancer precursor with an infiltrating atmosphere to form a gaseous species and/or (2) a reaction product of the infiltration enhancer precursor and the infiltrating atmosphere and/or (3) a reaction product of the infiltration enhancer precursor and the filler material or preform. Moreover, the infiltration enhancer may be supplied directly to at least one of the preform, and/or matrix metal, and/or infiltrating atmosphere and function in a substantially similar manner to an infiltration enhancer which has formed as a reaction between an infiltration enhancer precursor and another species. Ultimately, at least during the spontaneous infiltration, the infiltration enhancer should be located in at least a portion of the filler material or preform to achieve spontaneous infiltration and the infiltration enhancer may be at least partially reducible by the matrix metal.

"Infiltration Enhancer Precursor" or "Precursor to the Infiltration Enhancer", as used herein, means a material which when used in combination with (1) the matrix metal, (2) the filler material, and/or (3) an infiltrating atmosphere forms an infiltration enhancer which induces or assists the matrix metal to spontaneously infiltrate the filler material. Without wishing to be bound by any particular theory or explanation, it appears as though it may be necessary for the precursor to the infiltration enhancer to be capable of being positioned, located or transportable to a location which permits the infiltration enhancer precursor to interact with the infiltrating atmosphere and/or the filler material and/or the matrix metal. For example, in some matrix metal/infiltration enhancer precursor/infiltrating atmosphere systems, it is desirable for the infiltration enhancer precursor to volatilize at, near, or in some cases, even somewhat above the temperature at which the matrix metal becomes molten. Such volatilization may lead to: (1) a reaction of the infiltration enhancer precursor with the infiltrating atmosphere to form a gaseous species which enhances wetting of the filler material or preform by the matrix metal; and/or (2) a reaction of the infiltration enhancer precursor with the infiltrating atmosphere to form a solid, liquor or gaseous infiltration enhancer in at least a portion of the filler material or preform which enhances wetting; and/or (3) a reaction of the infiltration enhancer precursor within the filler material or preform which forms a solid, liquid or gaseous infiltration enhancer in at least a portion of the filler material or preform which enhances wetting.

"Low Particle Loading" or "Lower Volume Fraction of Filler Material", as used herein, means that the amount of matrix metal relative to filler material has been increased relative to a filler material which is highly loaded and not diluted (e.g., a spontaneously infiltrated filler material without having an additional or second matrix alloy added thereto).

"Macrocomposite", as used herein, means any combination of two or more materials in any configuration which are intimately bonded together by, for example, a chemical reaction and/or a pressure or shrink fit, wherein at least one of the materials comprises a metal matrix composite. The metal matrix composite may be present as an exterior surface and/or as an interior surface. It should be understood that the order, number, and/or location of a metal matrix composite body or bodies relative to residual matrix metal and/or second bodies can be manipulated or controlled in an unlimited fashion.

"Matrix Metal" or "Matrix Metal Alloy", as used herein, means that metal which is utilized to form a metal matrix composite (e.g, before infiltration) and/or that metal which is intermingled with a filler material to form a metal matrix composite body (e.g., after infiltration). When a specified metal is mentioned as the matrix metal, it should be understood that such matrix metal includes that metal as an essentially pure metal, a commercially available metal having impurities and/or alloying constituents therein, an intermetallic compound or an alloy in which that metal is the major or predominant constituent.

"Matrix Metal/Infiltration Enhancer Precursor/Infiltrating Atmosphere System" or "Spontaneous System", as used herein, refers to that combination of materials which exhibit spontaneous infiltration into a preform or filler material. It should be understood that whenever a "/" appears between an exemplary matrix metal, infiltration enhancer precursor and infiltrating atmosphere, the "/" is used to designate a system or combination of materials which, when combined in a particular manner, exhibits spontaneous infiltration into a preform or filler material.

"Metal Matrix Composite" or "MMC", as used herein, means a material comprising a two- or three-dimensionally interconnected alloy or matrix metal which has embedded a preform or filler material. The matrix metal may include various alloying elements to provide specifically desired mechanical and physical properties in the resulting composite.

A Metal "Different" from the Matrix Metal means a metal which does not contain, as a primary constituent, the same metal as the matrix metal (e.g., if the primary constituent of the matrix metal is aluminum, the "different" metal could have a primary constituent of, for example, nickel).

"Nonreactive Vessel for Housing Matrix Metal" means any vessel which can house or contain a filler material (or preform) and/or molten matrix metal under the process conditions and not react with the matrix and/or the infiltrating atmosphere and/or infiltration enhancer precursor and/or a filler material (or preform) in a manner which would be significantly detrimental to the spontaneous infiltration mechanism.

"Reservoir", as used herein, means a separate body of matrix metal positioned relative to a mass of filler or a preform so that, when the metal is molten, it may flow to replenish, or in some cases to initially provide and subsequently replenish, that portion, segment or source of matrix metal which is in contact with the filler or preform.

"Second Matrix Metal" or "Additional Matrix Metal", as used herein, means that metal which remains or which is added after infiltration of the filler material has been completed or substantially completed, and which is admixed with the infiltrated filler material to form a suspension of infiltrated filler material and first and second (or additional) matrix metals, thereby forming a lower volume fraction of filler material, such second or additional matrix metal having a composition which either is exactly the same as, similar to or substantially different from the matrix metal which has previously spontaneously infiltrated the filler material.

"Spontaneous Infiltration", as used herein, means the infiltration of matrix metal into the permeable mass of filler or preform occurs without requirement for the application of pressure or vacuum (whether externally applied or internally created).

"Suspension of Filler Material and Matrix Metal" or "Suspension", or "Metal Matrix Composite Suspension", as used herein, means a mixture of filler material and molten matrix metal.

BRIEF DESCRIPTION OF THE DRAWINGS

The following figures are provided to assist in understanding the invention, but are not intended to limit the scope of the invention. Similar reference numerals have been used wherever possible in each of the figures to denote like components, wherein:

FIG. *1a* is a cross-sectional schematic view of a layup used to fabricate a highly loaded metal matrix composite body according to the first technique of Example 1;

FIG. *1b* is a cross-sectional schematic view of a layup used to fabricate a highly loaded metal matrix composite body according to the second technique of Example 1;

FIG. *2a* is a cross-sectional schematic view which shows the introduction of a highly loaded metal matrix composite into a melt comprising a second or additional matrix metal contained within a crucible and the crushing of any loosely bound filler material from the highly loaded metal matrix composites;

FIG. *2b* is a cross-sectional schematic view that shows the introduction of a stirring means into the crucible containing molten first, and second or additional matrix metals and the crushed filler material of the highly loaded metal matrix composite;

FIG. *2c* is a cross-sectional schematic view that shows a formed molten suspension;

FIG. *2d* is a cross-sectional schematic view that shows a formed molten suspension being poured.

Figure 4:
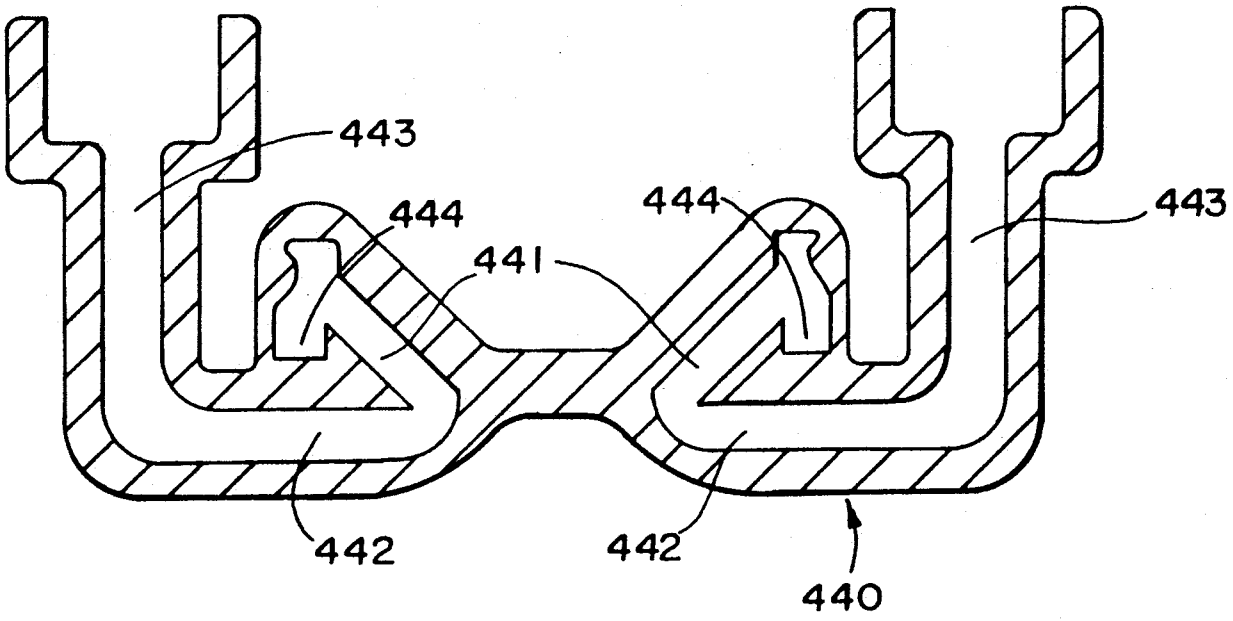

FIG. *3a* is a optical photomicrograph taken at about 200× magnification corresponding to the microstructure at a distance of about 10 mm from the bottom of the metal matrix composite body of Sample O in Example 1;

FIG. *3b* is a optical photomicrograph taken at about 200× magnification corresponding to the microstructure at a distance between about 5 mm and about 10 mm from the bottom of the metal matrix composite body of Sample O in Example 1;

FIG. *3c* is a optical photomicrograph taken at about 200× magnification corresponding to the microstructure at a distance of about 5 mm from the bottom of the metal matrix composite body of Sample O in Example 1;

FIG. *3d* is a optical photomicrograph taken at about 200× magnification corresponding to the microstructure of the bottom of the metal matrix composite body of Sample O in Example 1; and FIG. 4 is a cross-sectional schematic view that shows an investment shell incorporating gates, risers, and sediment traps to form the truncated conical annulus composite body of Example 2.

DETAILED DESCRIPTION OF THE PREFERRED EMBODIMENTS

A composite body having graded properties is produced by forming a molten suspension of filler and matrix metal and placing the molten suspension into the shaped cavity of a mold. The molten suspension is maintained in the mold at a sufficient temperature and for a sufficient amount of time to permit the filler in the molten suspension to at least partially settle within the mold. When the filler is carefully chosen (e.g., combinations of specific particle size distributions, and/or specific particle density distributions and/or specific particle chemical compositions, etc.), the filler can be controlled so that it desirably settles within a bottom portion of the mold, due to, for example gravitational forces. Such settling of filler from the molten suspension into the bottom portion of a mold can result in a desirable metal matrix composite body having graded properties and/or a desirable macrocomposite body, at least a portion of which comprises a graded metal matrix composite body or both.

For example, bodies can be produced such that the following exemplary properties are achieved: graded thermal conductivities, graded thermal expansion coefficients, graded mechanical strengths, graded electrical conductivities, etc. Accordingly, by appropriately selecting a particle size distribution, and/or an appropriate density distribution of filler, and/or different morphological properties of the filler, advantage can be taken of, for example, differences in settling times of different portions of the filler which leads to a grading of a metal matrix composite body or metal matrix composite region (i.e., a filler-rich region) of a macrocomposite body. Thus, bodies can be manufactured such that there is a primarily metal-rich region and a primarily filler-rich region, whereby the primarily filler-rich region can be graded from one side to the other.

Control of the volume percent of filler and/or the composition or density of filler within a metal matrix composite region (i.e., a filler-rich region) of a macrocomposite body can be achieved by, as discussed above, appropriately selecting different size, composition and/or density distributions of filler, the temperature to which a suspension is subjected to in a mold, the dwell time for the suspension within a mold, the morphology of the filler, any chemical reactions between the filler and the matrix metal, the chemical compositions of the matrix metal, etc.

For example, if an aluminum matrix metal was chosen in combination with a substantially nonreactive filler, the viscosity of the matrix metal could be modified by, for example, adding silicon. Such addition of silicon would change the viscosity of the matrix metal and would thus have an affect upon the amount of time that any individual filler particle would require for traveling a certain distance to settle. Accordingly, the viscosity of a matrix metal can be adjusted by referring to conventional resources which show viscosity variations as a function of composition for any given temperature. Similarly, viscosity can be adjusted by raising or lowering temperatures to which the suspension contained within the mold is subjected. For example, typically, the raising of temperature results in a lowering of viscosity. Accordingly, for any given dwell time, if a temperature is increased, the amount of time that it takes for filler to travel a given distance to settle should decrease. Still further, the morphology of filler including size, shape and density of the filler may also have an affect on the amount of time necessary for a filler to travel a given distance to settle.

Another factor which may influence the rate of settling of a filler is the volume percent of filler which is present in a suspension. For example, when the volume percent of filler increases in a suspension, the potential for more particle-particle interactions within the suspension also increases. Such particle-particle interactions also have an influence on the rate of settling of the filler (e.g., the more interactions a particle experiences during settling, the longer the settling time).

Still further, the amounts of different types of filler also may have an impact on the rate of settling of a filler within a suspension. For example, in general, the smaller the particle size of a filler, the longer the time required for the filler to travel a given settling distance relative to a larger-size particle of substantially the same shape and density. Accordingly, in a given matrix metal and at a given temperature, large spheres will settle faster than small spheres, so long as the large spheres and small spheres have about the same density. However, by carefully selecting filler distributions such that the distributions are bimodal, trimodal, etc., advantage can be taken of different rates of settling of the filler. For example, it has been discovered that a bimodal particle size distribution present in a suspension can result in co-settling of both large size particles and small size particles at desired locations within a filler-rich region of a macrocomposite body and/or a metal matrix composite body. Specifically, for example, a suspension formed from a mixture of an about 220 grit material in about 70 volume percent and an about 500 grit material in about 30 volume percent can, after settling, result in the formation of very dense regions in a filler-rich portion of a macrocomposite body. The aforementioned dense regions correspond to high particle packing efficiency which is achieved by combining a correct proportion of large-size particles to a correct proportion of smaller-size particles. Such packing efficiency can result in a maximum volume percent of filler being located in a metal matrix composite body and/or in a filler-rich region of a macrocomposite body.

It has been discovered that desirable amounts of filler in the suspension range between about 15 volume percent to about 30 volume percent. However, greater or lesser volume percents of filler in a suspension are possible depending on all of the other characteristics of the suspension and the settling process including: composition of matrix metal, temperature, affinity of the filler for the matrix metal, etc. Still further, by appropriately selecting filler material distributions, it is possible to tailor the amount of gradation (e.g., the volume percent of filler) in a filler-rich region of a macrocomposite body or in the metal matrix composite body itself. Such gradation is possible by, for example, choosing particle size distributions which result in one particle size preferentially rapidly settling and a second particle size settling at a relatively slower rate. The result of differential settling can be gradation across the filler-rich region of macrocomposite bodies as well as gradation across metal matrix composite bodies per se.

It should be noted that in all cases where a macrocomposite body is formed, it is, of course, possible to remove any attached metal from the filler-rich region. Such removal can occur from techniques such as machining, grinding, leaching, etc. Thus, whenever reference is made to macrocomposite bodies it should be understood that graded metal matrix composite bodies may also be independently formed.

Various techniques for forming a suspension comprising a filler in a matrix metal are applicable to the present invention. For example, powdered matrix metal and filler can be mixed and heated to form a suspension. Alternatively, a molten body of matrix metal can be provided into which a filler is poured and mixed by an appropriate agitation means. Still further, a filler can be infiltrated by any appropriate technique including pressure casting, spontaneous or pressureless infiltration, etc., to form a molten suspension.

When spontaneous infiltration is chosen as the desired technique for forming a molten suspension, the suspension is formed by first spontaneously infiltrating a filler material with a first matrix metal in an infiltrating atmosphere and thereafter adding additional or second matrix metal to the infiltrated filler material to result in a suspension of lower volume fraction of filler material in the matrix metal. Furthermore, the addition of the second matrix metal enables the process to be tailored to provide a metal matrix in the composite body of the first matrix metal (i.e., where the first and second matrix metal are the same) or an intermetallic or alloy of the first and second matrix metals (i.e., where the first and second matrix metals are different). Once spontaneous infiltration of a filler has occurred, additional matrix metal can be added by any number of different means including providing excess matrix metal from that which is necessary to achieve substantially complete infiltration of the filler and thereafter mixing the excess matrix metal with the infiltrated filler; or first forming a highly loaded metal matrix composite and thereafter reheating the highly loaded metal matrix composite and dispersing additional matrix metal therein to create a suspension of filler material and matrix metal.

In all instances, once a molten suspension is formed, the suspension is caused to be located by pouring, casting, injecting, etc., said suspension into a cavity of a mold of a desirable size and shape. The amount of time that the suspension is housed or dwells within the mold and the temperature which the suspension experiences during such dwell time contributes to the type and/or amount of filler settling which occurs. Accordingly, it is the synergism between all ingredients in the molten suspension, as well as the temperature to which the molten suspension is subjected and the time which the molten suspension dwells within a mold (i.e., the amount of time prior to the matrix metal of the molten suspension hardening) which influence the properties of a formed graded composite body.

As discussed above, the present invention can provide for the formation of graded metal matrix composite bodies per se or graded metal matrix composite bodies (i.e., filler-rich regions) integrally attached to matrix metal (i.e., macrocomposite bodies). To form a graded metal matrix composite body, it is necessary to remove excess matrix metal either while the matrix metal is still molten but after settling of the filler from the suspension or by physically removing hardened matrix metal after the metal has cooled (by such techniques as machining, grinding, leaching, etc.). Moreover, in many cases it may be desirable to form a macrocomposite body comprising a primarily metal-rich region from which the filler has settled and a primarily filler-rich region (i.e., a metal matrix composite region) which can be made to have graded properties based upon controlling the filler settling in the filler-rich region. When such a macrocomposite body is formed, it is possible to form the macrocomposite to contain an area which is primarily a metal matrix composite (i.e., a filler-rich region) integrally attached to matrix metal (i.e., a metal-rich region). It is possible to select the amounts of filler relative to matrix metal so that the amounts or thicknesses of the two regions can vary to create a virtually unlimited number of bodies. For example, a macrocomposite could be formed that had a very thin metal matrix composite region and a very thick matrix metal region. Alternatively, the macrocomposite could have a very thick metal matrix composite region and a very thin matrix metal region.

Virtually any matrix metal is compatible with the techniques of the present invention; however, preferable matrix metals include aluminum, magnesium, copper, bronze, cast iron, silicon, titanium, nickel, zirconium, hafnium and mixtures thereof. Additionally, suitable materials for use as the filler include ceramic materials such as oxides, carbides, nitrides and borides which can be present in various shapes including particles, fibers, platelets, etc. In preferred embodiments of the invention, it has been found that at least bimodal particle size distributions and/or bimodal density distributions of filler provide for the most desirable results in forming graded metal matrix composite bodies.

Thus, the present invention provides for sufficient flexibility in forming graded metal matrix composite bodies as well as macrocomposite bodies containing graded metal matrix composite portions (i.e., filler-rich regions).

Various demonstrations of the present invention are included in the examples immediately following. However, these examples should be considered as being illustrative and should not be construed as limiting the scope of the invention as defined in the appended claims.

EXAMPLE 1

This example demonstrates the fabrication of a composite body having a graded filler loading by a "three step" process. In a first step, a highly loaded metal matrix composite is prepared by spontaneously infiltrating a matrix metal into a permeable mass of filler material and thereafter solidifying the matrix metal. In the second step, the formed highly loaded metal matrix composite is reheated and dispersed into the melt of an additional or second matrix metal to form a molten suspension. In the third step, the molten suspension is cast and the dispersed filler within the molten matrix metal sediments to the bottom of a container so as to form composite body with a graded filler loading. The assemblies used to carry out some of these steps are depicted schematically in FIGS. 1*a*, 1*b*, 2*a* and 2*b*, respectively.

The highly loaded metal matrix composite can be formed by a variety of different techniques. Two specific examples of such techniques follow. Specifically, these examples illustrate the methods used to form the highly loaded metal matrix composite bodies used to make the bodies identified as Samples A through O in Table I. Table I further summarizes the matrix metal, filler material, filler material size and distribution, the initial filler material loading of the molten suspension and the sedimentation time used to form the metal matrix composite bodies.

TABLE I

| Sample | Matrix Metal | Filler Material | Filler Material Size and Distribution | Initial Filler Material Loading (volume percent) | Sedimentation Time (minutes) |
|---|---|---|---|---|---|
| A | Al-12 wt % Si | silicon carbide* | 220 grit | 15 | 0 |
| B | Al-12 wt % Si | silicon carbide | 220 grit | 15 | 30 |
| C | Al-12 wt % Si | silicon carbide | 220 grit | 15 | 60 |
| D | Al-12 wt % Si | silicon carbide | 500 grit | 30 | 0 |
| E | Al-12 wt % Si | silicon carbide | 500 grit | 15 | 60 |
| F | Al-12 wt % Si | silicon carbide | 70 wt %, 220 grit, 20 wt % 500 grit, & 10 wt % 1000 grit | 25 | 0 |
| G | Al-12 wt % Si | silicon carbide | 70 wt %, 220 grit, 20 wt % 500 grit, & 10 wt % 1000 grit | 25 | 15 |
| H | Al-12 wt % Si | silicon carbide | 70 wt %, 220 grit, 20 wt % 500 grit, & 10 wt % 1000 grit | 25 | 35 |
| I | Al-12 wt % Si | silicon carbide | 70 wt %, 220 grit, 20 wt % 500 grit, & 10 wt % 1000 grit | 25 | 60 |
| J | Al-12 wt % Si | silicon carbide | 80 wt % 220 grit & 20 wt % 500 grit | 25 | 0 |
| K | Al-12 wt % Si | silicon carbide | 80 wt % 220 grit & 20 wt % 500 grit | 25 | 30 |
| L | Al-12 wt % Si | silicon carbide | 80 wt % 220 grit & 20 wt % 500 grit | 25 | 60 |
| M | Al-12 wt % Si | silicon carbide | 80 wt % 220 grit & 20 wt % 500 grit | 15 | 15 |
| N | Al-12 wt % Si | silicon carbide | 80 wt % 220 grit & 20 wt % 500 grit | 15 | 30 |
| O | Al-12 wt % Si | silicon carbide | 80 wt % 220 grit & 20 wt % 500 grit | 15 | 60 |

*39 CRYSTOLON ® silicon carbide, Norton Company. Worcester, MA unless otherwise noted.

Figure 1A:
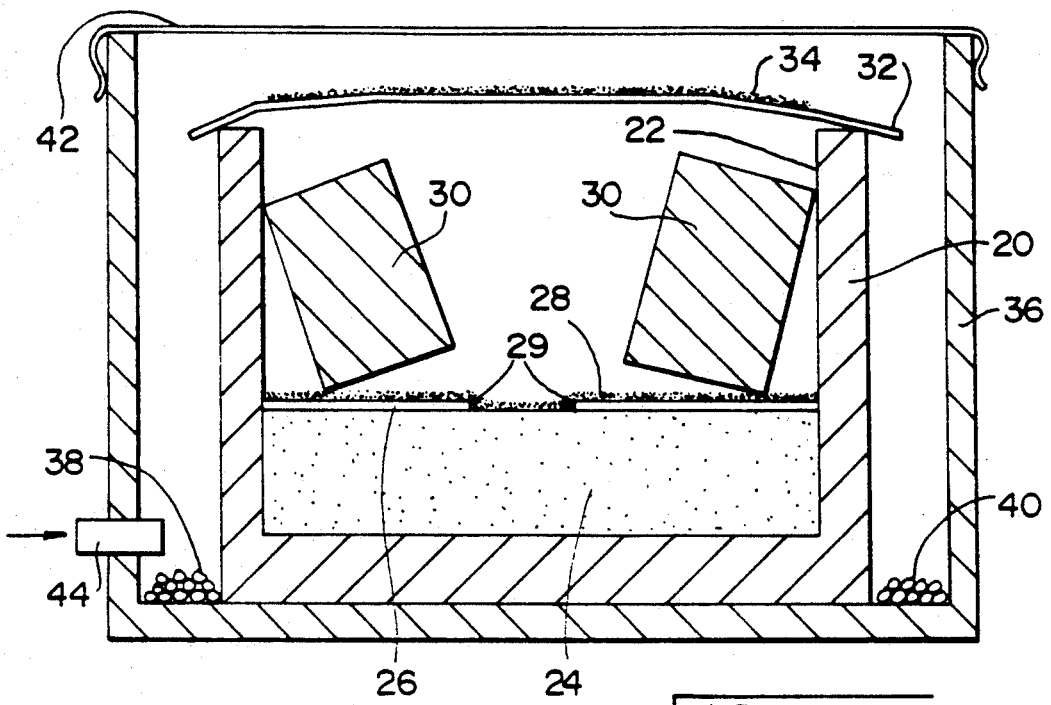

In a first technique for making a highly loaded matrix metal, and in reference to FIG. 1*a*, a filler material mixture 24 comprising about 1500 grams of 39 CRYSTOLON® 500 grit silicon carbide (Norton Co., Worcester, Mass.), having an average particle size of about 17 microns, and about 45 grams of −325 mesh magnesium powder (Reade Advance Materials, Rumson, N.J.) was ball milled for about an hour in an approximately 8.3 liter porcelain ball mill jar containing about 4000 grams of about 1 inch (25 mm) diameter alumina stones.

A Grade ATJ graphite mold 20 (Union Carbide Corporation, Carbon Products Division, Cleveland, Ohio) measuring about 6 inches (152 mm) square by about 2½ inches (64 mm) high was coated on the interior surfaces with a mixture comprised by weight of about 50% colloidal graphite (DAG® 154, Acheson Colloid Co., Port Huron, Mich.) and about 50% ethanol. A total of four coatings of the mixture were applied. The coated graphite mold 20 was then placed into an air atmosphere furnace and heated to about 380° C. at a rate of about 400° C. per hour. After holding at about 380° C. for about 2 hours to dry the colloidal graphite and form a graphite coating 22, the furnace was allowed to cool naturally. Once the furnace temperature had dropped below 100° C., the coated graphite mold 20 was retrieved from the furnace.

The filler material mixture 24 was poured into the coated graphite mold 20, levelled, and tamped repeatedly to pack the particles more closely together. A GRAFOIL® graphite foil 26 (Union Carbide Corporation, Carbon Products Division, Cleveland, Ohio) measuring about 6 inches (152 mm) square by about 0.010 inch (0.25 mm) thick and containing a hole 29 measuring about 1.5 inches (38 mm) in diameter was placed on top of the packed filler material mixture 24. Magnesium powder 28 (−50 mesh, Reade Advanced Materials) was sprinkled evenly over the top of the graphite foil 26 and the exposed filler material mixture 24 to a concentration of about 100 milligrams pre square inch (15.5 mg/cm$^2$). Several ingots of a matrix metal 30 comprising by weight about 12 percent silicon and the balance aluminum and collectively weighing about 2508 grams, were placed on top of the graphite foil 26, and more specifically, around but not on top of the hole 29 in the graphite foil 26, so that when the ingots 30 of matrix metal melted, only fresh matrix metal would come in contact with the filler material mixture 24. The top of the coated graphite mold 20 was covered with a piece of second graphite foil 32, the top of which was sprinkled additional magnesium powder 34 (−50 mesh, Reade Advanced Materials).

The coated graphite mold 20 and its contents were then placed into a stainless steel boat 36 measuring about 11 inches (279 mm) wide by about 12 inches (305 mm) long by about 14 inches (356 mm) high. Magnesium turnings 38 and titanium sponge 40 were also placed on the floor of the stainless steel boat around the outside of the coated graphite mold 20. A copper sheet 42 measuring about 15 inches (38 mm) wide by about 16 inches (406 mm) long by about 15 mils (0.38 mm) thick was placed over the top opening of the boat 36 and folded over the sides of the boat 36 to form an isolated chamber. A purge tube 44 for supplying nitrogen gas to the isolated chamber was provided through the side of the stainless steel boat 36.

The stainless steel boat 36 and its contents were then placed into a resistance heated air atmosphere furnace. The furnace door was closed, and a nitrogen flow rate of about 25 liters per minute was established within the stainless steel boat 36 through the purge tube 44 at ambient pressure. The furnace was heated to a temperature of about 225° C. at a rate of about 400° C. per hour, held at 225° C. for about 13.5 hours, then heated to about 550° C. at about 400° C. per hour, and held at about 550° C. for about 1 hour, then heated to 780° C. at about 400° C., and held at about 780° C. for about 3 hours. During this time, the matrix metal alloy spontaneously infiltrated the filler material mixture to produce a highly loaded metal matrix composite.

The stainless steel boat and its contents were retrieved from the furnace at a temperature of about 780° C. and placed on a refractory plate under a fume hood. The copper foil 42 and piece of second graphite foil 32 were removed and the still-molten carcass of matrix metal 30 was covered with an exothermic hot-topping particulate mixture (FEEDOL® No. 9, Foseco, Inc. Cleveland, Ohio) to establish a temperature gradient during cooling to directionally solidify the formed highly loaded metal matrix composite. Once a majority of the hot-topping mixture had reacted, the graphite boats and its contents were transferred to a water cooled copper quench plate to maintain the temperature gradient. After cooling to substantially room temperature, the formed metal matrix composite and the carcass of matrix metal were removed from the graphite boat, and the composite was separated from the carcass.

Figure 1B:
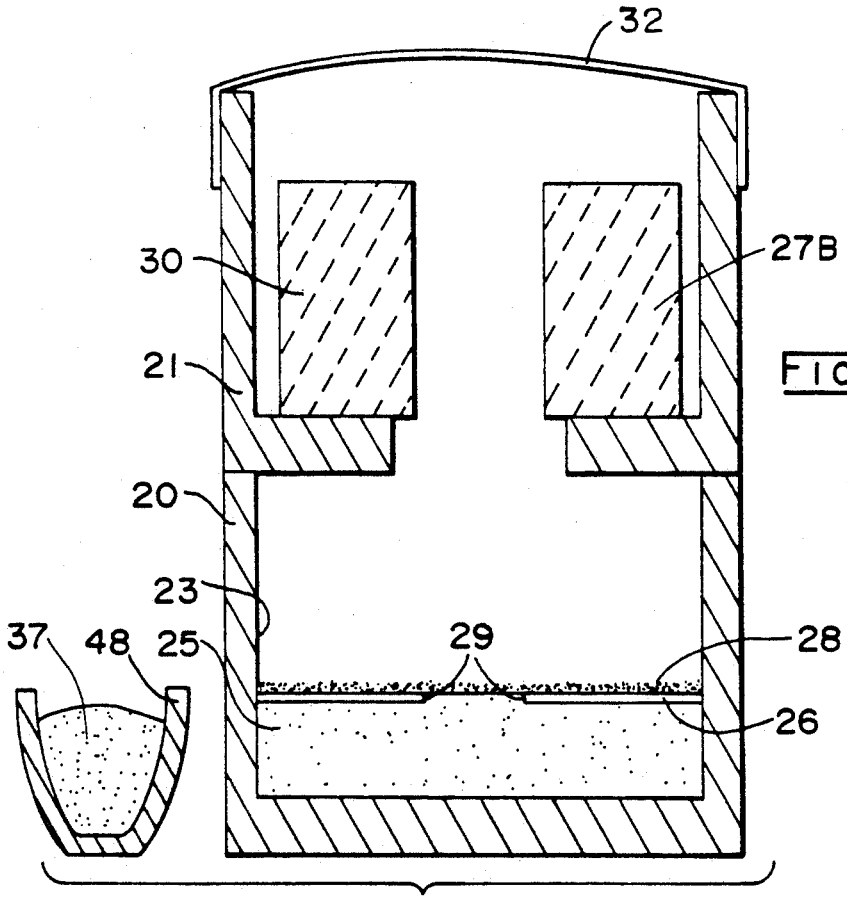

In a second technique for making a highly loaded metal matrix composite body, the setup, as shown in FIG. 1*b*, was used. Specifically, about 1500 grams of a filler material mixture 25 comprising by weight about 3.0% magnesium particulate (−325 mesh, Hart Corporation, Tamaqua, Pa.) and the balance 39 CRYSTOLON® 500 grit green silicon carbide particulate (Norton Company, Worcester, Mass.) having an average particle size of about 17 microns, was placed into a porcelain ball mill having a capacity of about 8.3 liters (U.S. Stoneware Corporation, Mahwah, N.J.). About 4000 grams of alumina based milling media, each having a diameter of about 1.0 inch (25 mm) was placed into the ball mill. The filler material mixture was ball milled for about 2 hours, and then poured into a graphite boat 20 having a wall thickness of about ¼ inch (6 mm) to ½ inch (13 mm) and whose interior measured about 6½ inches (165 mm) square by about 4.0 inches (102 mm) deep. The interior of the graphite boat had previously been coated with about four (4) thin coats of a mixture comprised by weight of 50% DAG® 154 colloidal graphite (Acheson Colloids Company, Port Huron, Mich.) and 50% ethanol and then had been dried at a temperature of about 380° C. in air for about 2 hours to form a graphite coating 23.

The graphite boat 20 and its contents were then placed into a vacuum drying oven and held at a temperature of about 225° C. for about 12 hours to remove any residual moisture from the ball-milled filler material mixture 25. The graphite boat 20 was then shaken to level the filler material mixture 25 contained within and then tapped gently several times to pack the filler material particles more closely together. A GRAFOIL® graphite foil 26 (Union Carbide Corporation, Carbon Products Division, Cleveland, Ohio) measuring about 6 inches (152 mm) square by about 0.010 inch (0.25 mm) thick and containing a hole 29 measuring about 1.5 inches (38 mm) in diameter was placed on top of the packed filler material mixture 25. A layer of magnesium particulate 28 (−325 mesh, Hart Company, Tamaqua, Pa.) was then sprinkled evenly over the top surface of the graphite foil and the exposed filler material mixture 25 to a concentration of about 400 milligrams per square inch (16 milligrams per square centimeter).

Several ingots of a matrix metal 30 comprised by weight of about 12.0 percent silicon and the balance aluminum, and totaling about 2478 grams, were placed into a second graphite boat 21 whose interior measured about 6½ inches (165 mm) square by about 4.0 inches (102 mm) deep and whose wall thickness measured about ¼ (6 mm) to ½ (13 mm) inch thick. This second graphite boat 21 also featured an approximately 2.0 inch (51 mm) diameter hole in its base. The top opening of this second graphite boat 21 was covered loosely with a sheet of GRAFOIL® graphite foil 32 (Union Carbide Company, Carbon Products Division, Cleveland, Ohio) and its edges were folded down over the sides of the second graphite boat 21. The second graphite boat 21 and its contents were then placed directly atop the first graphite boat 20 and its contents and both were placed into a retort furnace. About 30 grams of aluminum nitride particulates 37 (Advanced Refractory Technologies, Inc., Buffalo, N.Y.) were placed into a refractory crucible 48 which in turn was placed into the retort furnace adjacent to the stacked graphite boats 20, 21 to help getter residual oxidizing gases from the retort atmosphere.

The retort was sealed and the retort atmosphere was then evacuated using a mechanical roughing pump. The retort was then backfilled with nitrogen gas to approximately atmospheric pressure. A nitrogen gas flow rate through the retort of about 15 liters per minute was established and maintained. The furnace was then heated from about room temperature to a temperature of about 220° C. at a rate of about 400° C. per hour. After maintaining a temperature of about 225° C. for about 10 hours, the temperature was then increased to about 550° C., again at a rate of about 400° C. per hour. After maintaining a temperature of about 550° C. for about 1 hour, the temperature was then further increased to about 780° C. again at a rate of about 400° C. per hour. After maintaining a temperature of about 780° C. for about 4 hours, the retort chamber was opened and the stacked graphite boats 20, 21 were removed to reveal that the matrix metal 30 had melted and spilled through the hole in the base of the second graphite boat 21 onto the filler material 35 in the first graphite boat 20 and the matrix metal 30 had spontaneously infiltrated the filler material mixture 25 to form a highly loaded metal matrix composite. The second graphite boat 21 was removed from the first graphite boat 20 and the first graphite boat 20 containing the formed highly loaded metal matrix composite was placed onto a chill plate to effect directional solidification of the metal matrix composite body. The exposed surface of the metal matrix composite body was covered with a sufficient amount of FEEDOL® No. 9 hot topping particulate mixture (Foseco, Inc., Cleveland, Ohio) to assist in maintaining a temperature gradient during directional solidification. Upon cooling to about room temperature, the highly loaded metal matrix composite body was removed from the graphite boat 20. The surface of the highly loaded metal matrix composite was cleaned by grit blasting.

Figure 2A:
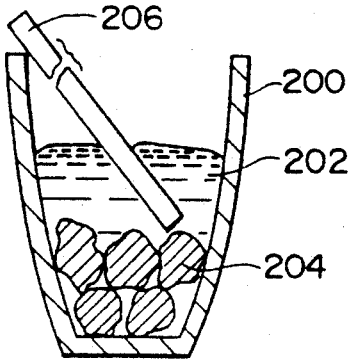
Figure 2B:
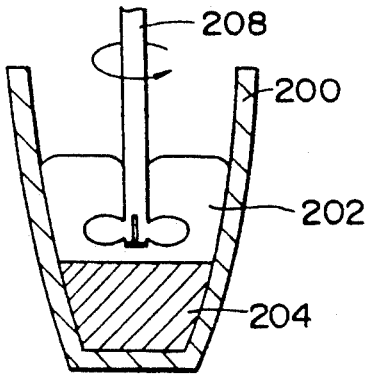
Figure 2C:
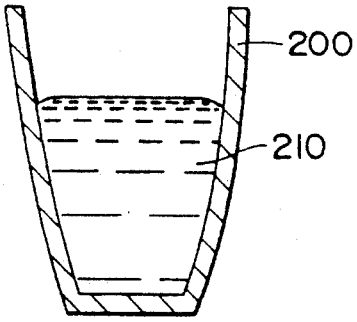
Figure 2D:
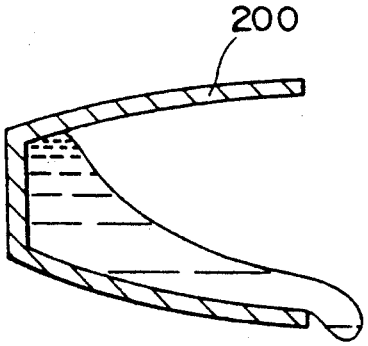

In the second step for forming composite bodies corresponding to Sample A through Sample O of Table I, additional matrix metal ingots comprising by weight about 12 percent silicon and the balance aluminum were placed into silicon carbide crucibles 200 having an opening measuring about 6 inches (152 mm) in diameter at the top, 3 inches (76 mm) in diameter at the base, and about 8 inches (203 mm) high. Each of the crucibles 200, one at a time, was then placed into coils of an induction furnace. The coils of the induction furnace were then energized to couple with the additional matrix metal ingot to melt it. Once the additional matrix metal ingot had melted, the melt was protected by an argon blanket and the surface dross was scraped off from the melt 202 of the metal ingot. Irregularly shaped pieces of highly loaded metal matrix composite material 204 having filler material size and distribution as designated for Sample A through Sample O of Table I, formed substantially as described above and preheated to about 300° C., were placed into the melt 202 of the additional matrix metal. After the matrix metal in the highly loaded metal matrix composite bodies became molten, additional pieces of the highly loaded metal matrix composite material 204 were added until the prescribed initial filler material loading, as indicated in Table I, was attained to yield a total weight of about 5000 grams. A preheated stainless steel rod 206 coated with colloidal graphite (DAG® 154, Acheson Colloids Co.) and measuring about ½ inch (13 mm) in diameter and about 24 inches (610 mm) long was then inserted into the melt and used to crush the highly loaded metal matrix composite material, all of which are shown in FIG. 2*a*. The coated stainless steel rod 206 was removed from the melt 202 and, as shown in FIG. 2*b*, a fixture 208 was then placed into the melt. The fixture 208 comprises a 1½ (38 mm) diameter stainless steel impeller coated with colloidal graphite (DAG® 154, Acheson Colloid Co.) and mounted to a ½ inch (13 mm) diameter, 24 inch (610 mm) long shaft. The impeller was rotated at about 1500 rpm for about 3 minutes by a lab stirrer (Lab Master T51515 Mechanical Stirrer, Lightnin Mixer Co.) (not shown in the figure) located external to the induction furnace thereby forming a molten suspension 210, shown in FIG. 2*c*. The molten suspension 210 comprised the former highly loaded metal matrix composite material, now substantially uniformly diluted, and filler material therefrom being dispersed throughout the additional matrix metal. The impeller was removed from the molten suspension 210 and the coated stainless steel rod 206 was reinserted into the molten suspension 210 to confirm that the filler material agglomerates had been sufficiently comminuted and dispersed. The coated stainless steel rod 206 was again removed from the suspension 210 and the molten suspension 210 was poured from the crucible 200, as shown in FIG. 2*d*, and cast into graphite molds (not shown in the figure) coated with colloidal graphite (DAG® 154) measuring about 6 inches (152 mm) square by about 2.5 inches (64 mm) high. When the filler material dispersed in a molten suspension 210 was allowed to settle before directional solidification, the graphite mold and its contents were placed into an air atmosphere furnace for the time designated as "Sedimentation Time" and specified in Table I. After the specified sedimentation time had elapsed, the graphite mold was situated on top of a copper plate. Two sheets of GRAFOIL® graphite foil measuring about 6 inches (203 mm) square were placed on top of the matrix metal. The graphite foil was then covered with a sufficient amount of FEEDOL® No. 9 hot topping particulate mixture (Foseco, Inc., Cleveland, Ohio) to assist in maintaining a temperature gradient during directional solidification of the resultant composite body. After cooling to substantially room temperature, the solidified composite was removed from the mold.

Subsequent optical microscopy on polished cross sections of the solidified composite bodies revealed that the process of dispersing the highly loaded metal matrix composite material into additional matrix metal followed by a settling or sedimentation of the filler produced a composite body comprising a matrix metal body integrally attached to a graded filler-rich region (i.e., a metal matrix composite region).

To quantify further the effect of the variation of processing parameters on the resultant composite body, the volume fraction of filler, volume fraction of matrix metal and volume fraction of porosity, were determined by quantitative image analysis. Representative samples of the composite bodies were mounted and polished. The polished samples were placed on the stage of a Nikon Microphoto-FX optical microscope with a DAGE-MTI Series 68 video camera manufactured in Michigan City, Ind., attached to the top port. The video camera signal communicated with a Model CV-4400 Scientific Optical Analysis System produced by Lamont Scientific of State College, Pa. At an appropriate magnification, ten video images of the microstructure were acquired through the optical microscope and stored in the Lamont Scientific Optical Analysis System. Video images acquired at 50× to 100×, and in some cases at 200×, were digitally manipulated to even the lighting within the images. Video images acquired at 200× to 1000× required no digital manipulation to even the lighting. When video images had been lighting, specific color and gray level intensity ranges were assigned to specific microstructural features, specific filler material, matrix metal, or porosity, etc.). To verify that the color and intensity assignments were accurate, a comparison was made between a video image with assignments and the originally acquired video image. If discrepancies were noted, corrections were made to the video image assignments with a hand held digitizing pen and a digitizing board. Representative video images with assignments were analyzed automatically by the computer software contained in the Lamont Scientific Optical Analysis System to give area percent filler, area percent matrix metal and area percent porosity, which are substantially the same as volume percents (which were not measured directly).

The results of the quantitative image analysis for samples C, H, I, N and O performed at about a magnification of about 200× are as follows:

Sample C, which was formed with an initial filler loading in the suspension of about 15 volume percent 500 grit silicon carbide, settled after about sixty minutes at temperature to a total thickness of about 12 mm, and wherein the filler loading at the bottom of the metal matrix composite body corresponding to the bottom of the mold was about 53 volume percent and the filler loading at the top of the metal matrix composite body was about 20 volume percent.

Sample H, which was formed with an initial filler loading in the suspension of about 25 volume percent silicon carbide (70 wt % 220 grit, 20 wt % 500 grit, and 10 wt % 1000 grit), settled after about thirty-five minutes at temperature to a total thickness of about 16 mm, and wherein the filler loading of the metal matrix composite body corresponding to the bottom of the mold was about 48 volume percent and the filler loading at the top of the metal matrix composite body was about 36 volume percent.

Sample I, which was formed with an initial filler loading in the suspension of about 25 volume percent silicon carbide (70 wt % 220 grit, 20 wt % 500 grit, and 10 wt % 1000 grit) settled after about sixty minutes at temperature to a total thickness of about 11 mm and wherein the filler loading of the metal matrix composite body corresponding to the bottom portion of the mold was about 42 volume percent and the filler loading at the top of the metal matrix composite body was about 40 volume percent.

Sample N, which was formed with an initial filler loading in the suspension of about 15 volume percent silicon carbide (80 wt % 220 grit and 20 wt % 500 grit) settled after about thirty minutes at temperature to a total thickness of about 24 mm and wherein the filler loading of the metal matrix composite body corresponding to the bottom portion of the mold was about 46 volume percent and the filler loading at the top of the metal matrix composite body was about 29 volume percent.

Sample O, which was formed with an initial filler loading in the suspension of about 15 volume percent silicon carbide (80 wt % 220 grit and 20 wt % 500 grit) settled after about sixty minutes at temperature to a total thickness of about 9 mm and wherein the filler loading of the metal matrix composite body corresponding to the bottom portion of the mold was about 44 volume percent and the filler loading at the top of the metal matrix composite body was about 25 volume percent.

Figure 3A:
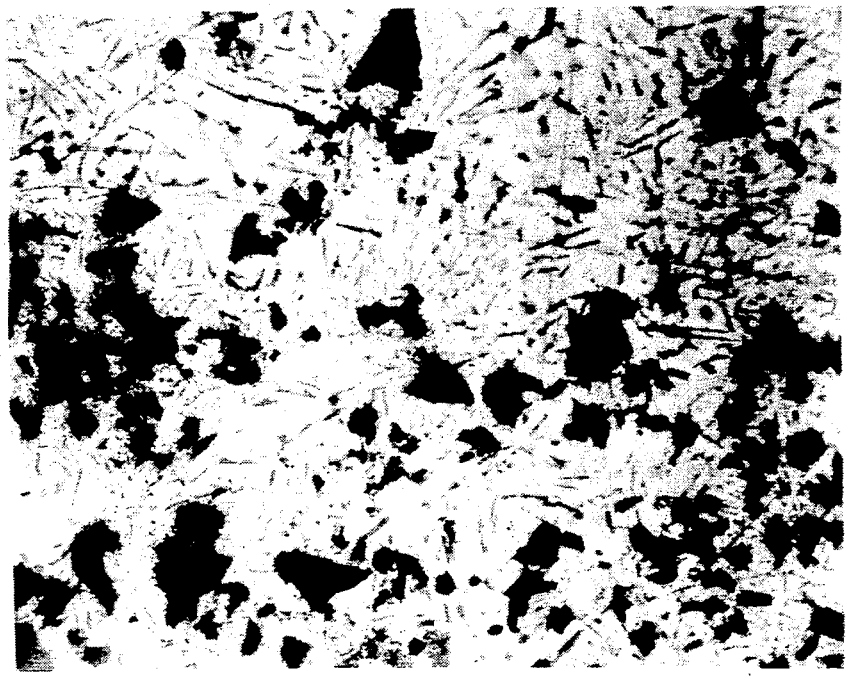
Figure 3B:
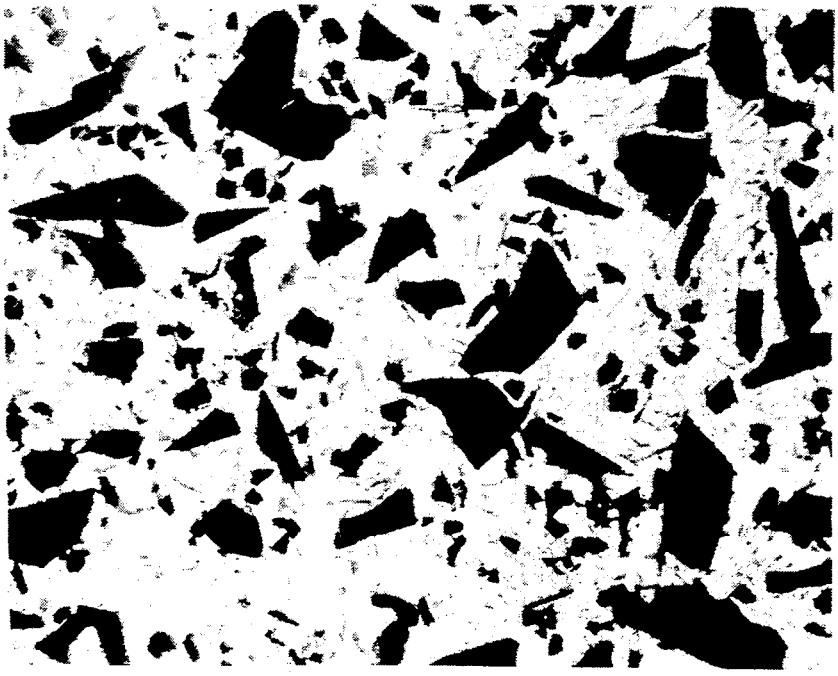
Figure 3C:
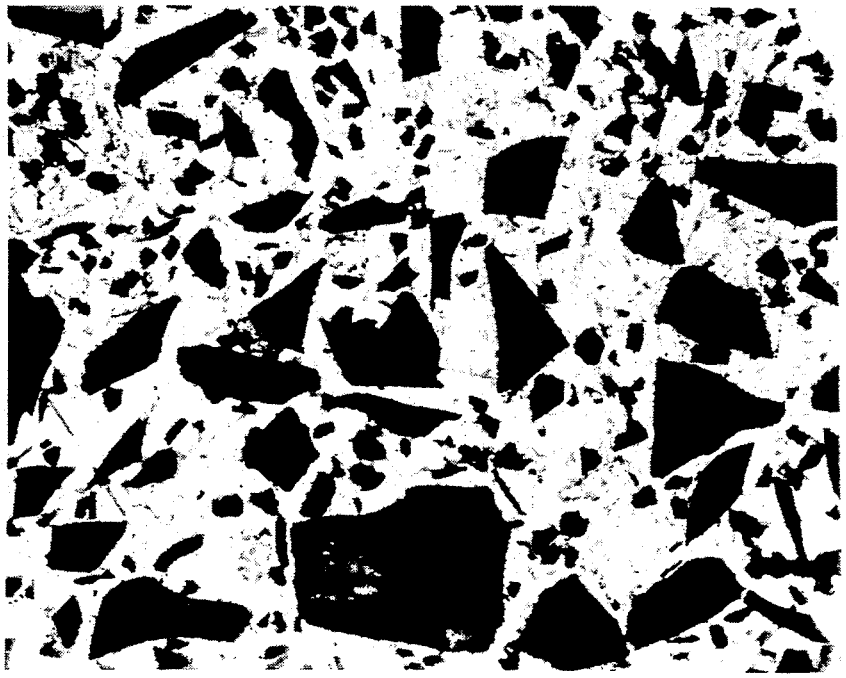
Figure 3D:
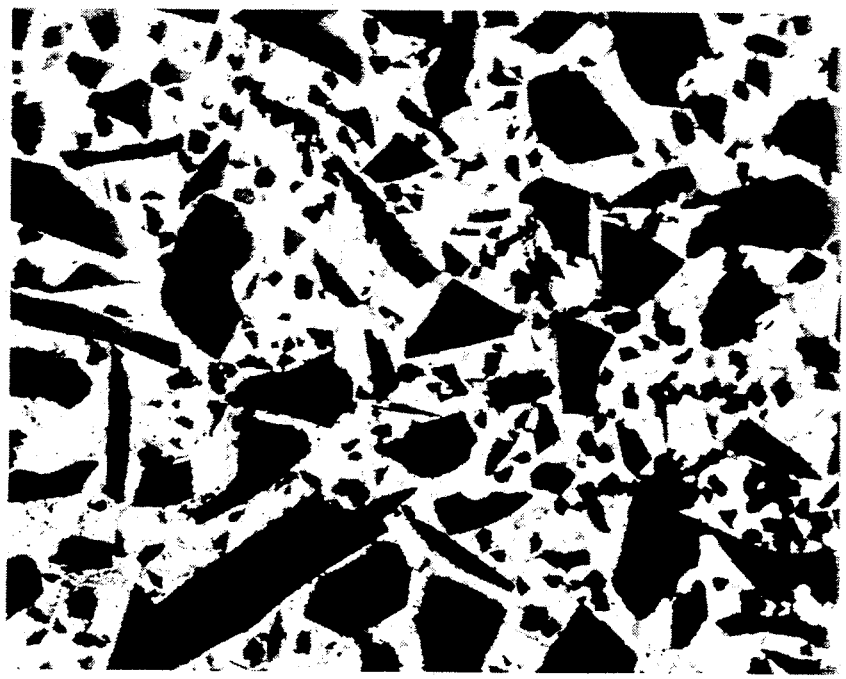

FIGS. 3*a* and 3*d* are photomicrographs taken at about 200× magnification corresponding to Sample O of Table I. FIGS. 3*a* through 3*d* show the variation of filler loading as a function of distance from the bottom of the metal matrix composite body of Sample O. Specifically, FIG. 3*d* corresponds to the microstructure of the bottom of the metal matrix composite body (i.e., that portion corresponding to a bottom of the mold); FIG. 3*c* corresponds to the microstructure at a distance of about 5 mm from the bottom of the metal matrix composite body; FIG. 3*b* corresponds to the microstructure at a distance between about 5 mm and about 10 mm from the bottom of the metal matrix composite body; and FIG. 3*a* corresponds to the microstructure of a distance of about 10 mm from the bottom of the metal matrix composite body.

Thus, this example demonstrates that by varying the filler material size and distribution, sedimentation time, and initial filler loading in the molten suspension, the resultant character of the formed composite body can be controlled.

EXAMPLE 2

This example demonstrates utilizing the techniques of the present invention to produce a truncated conical annulus. Moreover, this example demonstrates the fabrication of a composite body having a complex shape by casting a molten suspension into a ceramic investment shell.

A highly loaded metal matrix composite was fabricated substantially according to the first technique of Example 1, except that the filler material comprised by weight about 78 percent 39 CRYSTOLON® 220 grit silicon carbide, about 19 percent 39 CRYSTOLON® 500 grit silicon carbide, and about 3 percent −325 magnesium powder (Hart Corporation, Tamaqua, Pa.). The filler material was dried in a vacuum oven at about 150° C. and about 30 inches (762 mm) of mercury vacuum for about four hours. Additionally, the contents of the stainless steel can used to provide an isolated chamber included about 15 grams of aluminum nitride powder (Advanced Refractory Technologies, Inc., Buffalo, N.Y.).

The stainless steel boat and its contents were placed into a resistance heated air atmosphere furnace. The furnace door was closed, and a nitrogen flow rate of about 15 liters per minute was established within the stainless steel boat through the purge tube at ambient pressure. The furnace was heated to a temperature of about 220° C. at a rate of about 300° C. per hour, held at about 220° C. for about 11 hours, then heated to about 525° C. at about 400° C. per hour, and held at about 525° C. for about 1 hour then heated to about 780° C. at about 400° C. per hour, and held at about 780° C. for about 3 hours. During this time, the matrix metal alloy spontaneously infiltrated the filler material mixture to produce a highly loaded metal matrix composite.

An investment shell mold 440, depicted schematically in FIG. 4, shows the cavities for a truncated conical annulus 441, the attached gates 442, the attached risers 443, and the attached sedimentation traps 444. The investment shell had a composition typical for the aluminum metal foundry industry and was fabricated to produce a truncated conical annulus measuring about 1.6 inches high (41 mm) and had an outer diameter of about 5.4 inches (137 mm) and an inner diameter of about 4.4 inches (112 mm) at its base, and had an outer diameter of about 3.5 inches (89 mm) and an inner diameter of about 2.25 inches (57 mm) at the end opposite its base. The investment shell mold was heated to a temperature of about 900° C. in preparation for casting. About 2467 grams of additional matrix metal comprised of by weight of about 12 percent silicon and the balance aluminum were placed into a silicon carbide crucible substantially the same as that described in Example 1 and melted substantially as described in Example 1. When the approximately 2467 grams of additional matrix metal had melted, about 1562 grams of the highly loaded metal matrix composite were added to the melt to yield an initial filler loading in the suspension of about 20 volume percent. When the contents of the crucible had reached a temperature of about 725° C., a rod was inserted into the melt to breakup any remaining clumps of the highly loaded metal matrix composite. An impeller substantially the same as that described in Example 1 was inserted into the melt and the impeller was accelerated up to a rotation speed of about 1000 rpm. After mixing the melt for about 4 minutes at a speed of about 1000 rpm with the impeller to disperse the silicon carbide filler material throughout the first and additional matrix metals, the impeller was turned off and removed from the resulting molten suspension. After readjusting the molten suspension temperature to about 800° C., a portion of the molten suspension was immediately cast into the approximately 900° C. investment shell mold. The mold and its content were then placed into an air atmosphere furnace set at about 780° C. After about 15 minutes at about 780° C., during which time the filler settled, the investment shell was removed from the furnace and air quenched by directing compressed air at the investment shell mold.

Once the investment shell mold and its contents had cooled to about room temperature, the investment shell was removed with light hammer blows to reveal a composite body. The composite body comprised the truncated conical annulus body and its attached gates and risers. After removing the attached gates and risers from the truncated conical annulus body, it was cross sectioned to reveal that the body comprised a macrocomposite comprised of a matrix metal integrally attached to a metal matrix composite body having graded filler loading therein.

Thus this example demonstrates that complex-shaped composite bodies can be formed by the methods of the present invention.

What is claimed is:

1. A method for making a composite body having graded properties comprising:

providing a filler, said filler comprising at least one of at least a bimodal particle size distribution and at least a bimodal density distribution;

providing a matrix metal;

causing said filler and said matrix metal to form a molten suspension;

providing a mold having a shaped cavity therein;

placing said molten suspension into said shaped cavity;

maintaining said molten suspension within said mold for a sufficient amount of time to permit said filler in said molten suspension to at least partially settle within said mold; and solidifying said molten suspension, thereby forming a composite body having graded properties.

2. The method of claim 1, wherein said molten suspension is formed by mixing said filler into molten matrix metal by a stirring means.

3. The method of claim 2, wherein said stirring means comprises a mechanical stirring means.

4. The method of claim 1, wherein said method is practiced in an environment which does not adversely react with said filler and said molten matrix metal.

5. The method of claim 1, wherein said mold comprises a metal casting mold.

6. The method of claim 1, wherein said matrix metal comprises at least one material selected from the group consisting of aluminum, magnesium, copper, bronze, cast iron, silicon, titanium, nickel, zirconium, hafnium and mixtures thereof.

7. The method of claim 1, wherein said filler comprises at least one ceramic material.

8. The method of claim 7, wherein said ceramic material comprises at least one material selected from the group consisting of oxides, carbides, nitrides and borides.

9. The method of claim 1, wherein said particle size distribution is chosen so as to result in a graded settling of the filler within said mold, such that at least one property of the formed composite varies as a function of position within the composite body.

10. The method of claim 1, wherein an infiltration enhancer is placed onto at least a portion of a surface of said filler prior to forming said molten suspension.

11. The method of claim 1, wherein said matrix metal comprises aluminum and said filler comprises at least one ceramic material.

12. The method of claim 1, wherein said molten suspension is maintained within said mold at a sufficient temperature and for a sufficient amount of time to permit substantially all of said filler to settle within said mold, thereby forming a filler-rich region which is graded from one side to the other and a metal-rich region integrally attached to said filler-rich region.

13. The method of claim 12, wherein said graded filler-rich region comprises a first portion having a greater volume fraction of coarser or denser filler relative to an oppositely located second portion within said graded filler.

14. The method of claim 1, wherein said molten suspension is subjected to gravitational forces to induce said filler within said molten suspension to at least partially settle said filler within said mold.

15. The method of claim 1, wherein said filler comprises at least a bimodal particle size distribution.

16. The method of claim 1, wherein said filler comprises at least a bimodal density distribution.

17. A method for making a composite body having graded properties comprising:

providing a substantially nonreactive filler, said filler comprising at least one of at least a bimodal particle size distribution and at least a bimodal density distribution, said distribution being chosen such that at least one property of the formed composite varies as a function of position within the composite body;

spontaneously infiltrating at least a portion of the filler with molten matrix metal;

supplying additional matrix metal to said spontaneously infiltrated filler to form a molten suspension;

providing a mold having a shaped cavity therein;

placing said molten suspension into said shaped cavity;

maintaining said molten suspension within said mold for a sufficient amount of time to permit said filler in said molten suspension to at least partially settle within said mold; and solidifying said molten suspension, thereby forming a composite body having graded properties.

18. The method of claim 17, wherein an infiltrating atmosphere communicates with at least one of the filler and the matrix metal for at least a portion of the period of infiltration and at least one of an infiltration enhancer precursor and an infiltration enhancer are supplied to at least one of the matrix metal and the filler.

19. The method of claim 17, wherein said molten suspension is maintained within said mold at a sufficient temperature and for a sufficient amount of time to permit substantially all of said filler to settle within said mold, thereby forming a filler-rich region area which is graded from one side to the other and a metal-rich region integrally attached to said filler-rich region.

20. The method of claim 17, wherein said at least one property that varies as a function of position comprises at least one of electrical properties, thermal properties, strength properties, thermal expansion coefficient and wear resistance.

21. The method of claim 17, wherein said molten suspension is subjected to gravitational forces to induce said filler within said molten suspension to at least partially settle said filler within said mold.

22. The method of claim 17, wherein said filler comprises at least a bimodal particle size distribution.

23. The method of claim 17, wherein said filler comprises at least a bimodal density distribution.

24. A method for making a metal matrix composite body having graded properties comprising:

providing a matrix metal;

providing a substantially nonreactive filler comprising at least one material selected from the group consisting of a material having at least a bimodal particle size distribution, a material having at least a bimodal density distribution, a material having at least two chemical compositions, a material having at least two ingredients having different morphological properties and mixtures thereof;

providing a material comprising at least one of an infiltration enhancer and an infiltration enhancer precursor to at least one of said matrix metal, an interface between the matrix metal and said filler, and said filler;

providing an infiltrating atmosphere;

spontaneously infiltrating at least a portion of the filler with molten matrix metal;

combining additional matrix metal with said spontaneously infiltrated filler to form a molten suspension;

providing a mold having a shaped cavity therein;

placing said molten suspension into at least a portion of said shaped cavity;

maintaining said molten suspension within said mold for a sufficient amount of time to permit gravitational forces to induce said filler within said molten suspension to at least partially settle within said mold; and solidifying said molten suspension, thereby forming a composite body having graded properties.

* * * * *